US006874956B2

(12) United States Patent
Kelley et al.

(10) Patent No.: US 6,874,956 B2
(45) **Date of Patent: *Apr. 5, 2005**

(54) PRINTHEAD-TO-MEDIA SPACING ADJUSTMENT IN A PRINTER

(75) Inventors: Richard A. Kelley, Vancouver, WA (US); Wade A. Powell, Vancouver, WA (US); Anthony W. Ebersole, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/699,432

(22) Filed: Oct. 31, 2003

(65) Prior Publication Data

US 2004/0091297 A1 May 13, 2004

Related U.S. Application Data

(63) Continuation of application No. 09/940,268, filed on Aug. 27, 2001, now Pat. No. 6,663,302.

(51) Int. Cl.[7] ..... B41J 25/308; B41J 25/316
(52) U.S. Cl. ..... 400/59; 400/55; 347/8
(58) Field of Search ..... 347/8; 400/55, 400/56, 59

(56) References Cited

U.S. PATENT DOCUMENTS

| | | | | |
|---|---|---|---|---|
| 4,657,415 A | | 4/1987 | Kikuchi et al. | |
| 4,859,096 A | * | 8/1989 | Waibel | 400/157.2 |
| 5,000,594 A | | 3/1991 | Beehler et al. | |

FOREIGN PATENT DOCUMENTS

| | | | | |
|---|---|---|---|---|
| JP | 55084690 | | 6/1980 | |
| JP | 55159986 A | * | 12/1980 | B41J/25/28 |
| JP | 58108180 A | * | 6/1983 | B41J/25/30 |
| JP | 59012886 A | * | 1/1984 | B41J/25/28 |
| JP | 60154091 | | 8/1985 | |
| JP | 63041169 | | 2/1988 | |
| JP | 05050702 | | 3/1993 | |

* cited by examiner

*Primary Examiner*—Daniel J. Colilla

(57) ABSTRACT

Apparatus for adjusting printhead-to-media spacing in a printer having a frame and a shiftable printhead-carrying carriage mounted on the frame for lateral movement relative to the frame, the apparatus comprising a first immovable mechanical contact actuator anchored to the frame and disposed beyond one end of a print-job range, and a first movable mechanical contact actuator movable with the carriage, positioned toward that side of the carriage which generally faces the first fixed actuator, and engageable with the first fixed actuator during movement of the carriage beyond the one end of the print-job range to cause a positional adjustment of the carriage which effects a change in printhead-to-media spacing.

6 Claims, 6 Drawing Sheets

PRINTHEAD-TO-MEDIA SPACING ADJUSTMENT IN A PRINTER

CROSS-REFERENCE TO RELATED APPLICATION

This is a continuation of application Ser. No. 09/940,268 filed on Aug. 27, 2001, now U.S. Pat. No. 6,663,302 which is hereby incorporated by reference herein.

BACKGROUND

In a typical printer, such as an inkjet printer, the default printhead-to-media spacing is typically set to accommodate a commonly used, single-sheet-thickness, bond-weight paper, such as 20-lb. bond-weight paper. Envelopes and other print media are usually substantially thicker than a single sheet of such paper, and because of this, it is desirable to enable printhead-to-media spacing to be adjusted, either via user selection, or via automatic media thickness sensing, or both, so as to accommodate such thicker media.

To accomplish this kind of adjustment in the past, various approaches have been made which often involve the use of additional motors and electrical circuitry to effect changes in such spacing.

Typically, the carriage which supports the printheads is itself supported on two spaced structures, one of which is called a carriage rod, and the other of which is called an anti-rotation rail. The carriage is mounted for lateral shifting along and for rocking about the axis of the carriage rod. A portion of the carriage rides back and forth freely on the anti-rotation rail. Rocking of the carriage, which is usually produced by raising and lowering of the carriage where it overlies the anti-rotation rail, is effective to change printhead-to-media spacing. Additional motors and associated motor-driven mechanism, along with additional electrical circuitry, are what have often been introduced in the past to create such rocking of a carriage.

DETAILED DESCRIPTION

Figure 1:
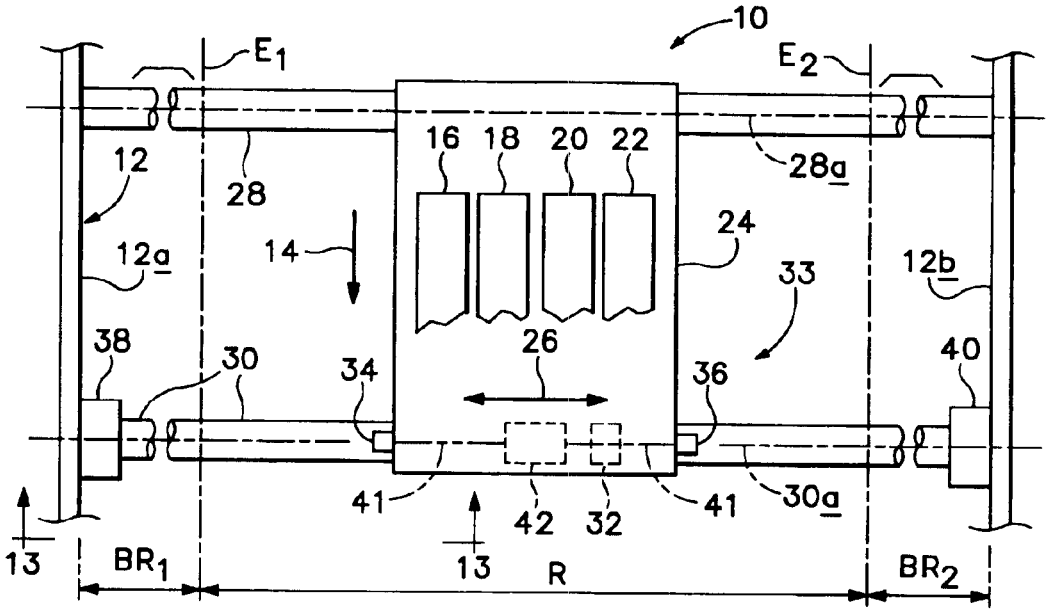
FIG. 1 is a simplified schematic plan view illustrating generally a printer which incorporates printhead-to-media spacing adjustment apparatus constructed in accordance with an embodiment of the present invention.

Turning now to the drawings, and referring first of all to FIG. 1, indicated generally at 10 is an inkjet printer having a frame 12 which includes lateral frame components 12*a*, 12*b* shown at the left and right sides, respectively, of FIG. 1. In FIG. 1, the front of the printer faces the bottom of the figure. Single-sheet papers, envelopes or other print media which are transported appropriately through the printer during a printing operation generally travel in the direction of arrow 14 along a print media path which includes a length that extends generally in a plane (the plane of FIG. 1) substantially directly beneath the structure shown in FIG. 1.

Printing is performed by inkjet cartridges, such as the four shown at 16, 18, 20, 22, that are appropriately carried on a printhead-carrying carriage 24.

Carriage 24 is mounted for reversible lateral shifting, generally as indicated by double-ended arrow 26, under the influence of suitable motor drive mechanism (not specifically shown). The rear of the carriage is supported on an elongate, generally cylindrical carriage rod 28 that extends between and is fastened to frame components 12*a*, 12*b*. Carriage 24 is also rockable vertically about the long axis 28*a* of rod 28. The front of the carriage rests by gravity on the upper surface of another elongate cylindrical rod 30 which also extends between and is fastened to the frame, such as through frame components 12*a*, 12*b*. Rod 30 functions in printer 10, and is also referred to herein, as an anti-rotation rail such as that mentioned earlier.

Appropriately provided on the underside of the front of carriage 24, and shown generally by the dashed-line rectangle labeled 32, is a bearing pad which normally rests on the upper surface of rail 30. Such engagement between pad 32 and rail 30 defines the preset default printhead-to-media spacing that is established in printer 10 at the time of its manufacture. While such default spacing need not necessarily be the smallest printhead-to-media spacing in a printer such as printer 10, here it is illustrated as being such. The capability of carriage 24 to rock as mentioned about axis 28*a* permits raising and lowering of the front of the carriage relative to rail 30. It is such rocking that is employed according to the present embodiment of the invention to vary the specific printhead-to-media spacing in order to accommodate different thicknesses of print media.

During a normal printing operation, carriage 24 begins from what can be thought of as a home position in the printer, which position, in FIG. 1, is toward the right side of the figure. From this home position, the carriage is nominally shifted to the left in FIG. 1 so that, during the printing operation, it reciprocates as indicated by double-headed arrow 26 within what is called herein a print-job range indicated at R in FIG. 1. The left end of this range is shown at $E_1$, and the right end of range R is shown at $E_2$.

In accordance with practice and operation of the present embodiment, and as will be further discussed below, there are certain instances in which travel of carriage 24 outwardly into two different regions that are laterally beyond the opposite ends of range R is employed to engage actuators that function to change, from one value to another, printhead-to-media spacing. These regions are shown at $BR_1$ and $BR_2$ relative to range ends $E_1$, $E_2$, respectively. The capital letters BR are employed herein to indicate a region which is beyond normal printing range. When carriage 24 is in its home position, the carriage extends somewhat into region $BR_2$.

The mechanism of the present embodiment takes advantage of lateral motion of carriage 24 relative to frame 12 into regions $BR_1$ and $BR_2$ to cause engagement between actuators that are constructed, as will shortly be described, to produce changes in printhead-to-media spacing by causing rocking of carriage 24 about axis 28*a*. According to one embodiment, pointed to generally by arrow 33 in FIG. 1, actuators for accomplishing such changes are provided and operate on opposite lateral sides of carriage 24 and frame 12. These actuators take advantage of carriage travel beyond both ends $E_1$, $E_2$ of range R, into ranges $BR_1$, $BR_2$, to produce, on one hand, an increase in printhead-to-media spacing relative to the default spacing, and on the other hand, a return to the smaller default spacing from such an increased spacing.

Included in the actuators that produce this behavior are two movable contact actuators 34, 36 which are illustrated simply as small blocks on the left and right sides, respectively, of the front of carriage 24, and two fixed (or stationary) contact actuators 38, 40, also represented by rectangular blocks, and effectively joined the frame structure generally toward the opposite ends of rail 30. Movable actuators 34, 36 travel back and forth, and upwardly and downwardly, with the carriage, and are appropriately drivingly connected as indicated by a dash-double-dot line 41, to a rotatable bearing structure pictured by a dashed block 42 which is carried on the carriage. Structure 42 operates selectively to engage and disengage anti-rotational rail 30, thereby to effect raising and lowering (through rocking) of the front of the carriage to produce changes in printhead-to-media spacing.

Directing attention now to FIGS. 2–12, inclusive, along with FIG. 1, one should first note that in FIGS. 2, 5, 6 and 8, the components shown there are illustrated with carriage 24 positioned in printer 10 within range R. Apparatus 33 includes an elongate shaft, or rotatable component, 44 which carries, adjacent its opposite ends, two suitably secured cams 46, 48. Shaft 44 functions as previously mentioned driving connection 41, and cams 46, 48 as movable contact actuators 34, 36. Also secured generally axially centrally to shaft 44 is rotatable bearing structure 42. Structure 42 has the form shown in FIGS. 3–7 and 9–12, inclusive, and contains an elongate finger 43 which extends generally radially from the long axis 44*a* of shaft 44.

Shaft 44, bearing structure 42, and cams 46, 48 substantially directly overlie anti-rotation rail 30, with axis 44*a* of shaft 44 disposed above and substantially paralleling the long axis 30*a* of rail 30. As can be seen particularly in FIGS. 5 and 6, cams 46, 48 and bearing structure 42 are exposed on the underside of the front of the carriage through windows 52, 54, 56, respectively, that are formed in a sheet of material 24*a* which forms part of the underside of carriage 24.

Figure 5:
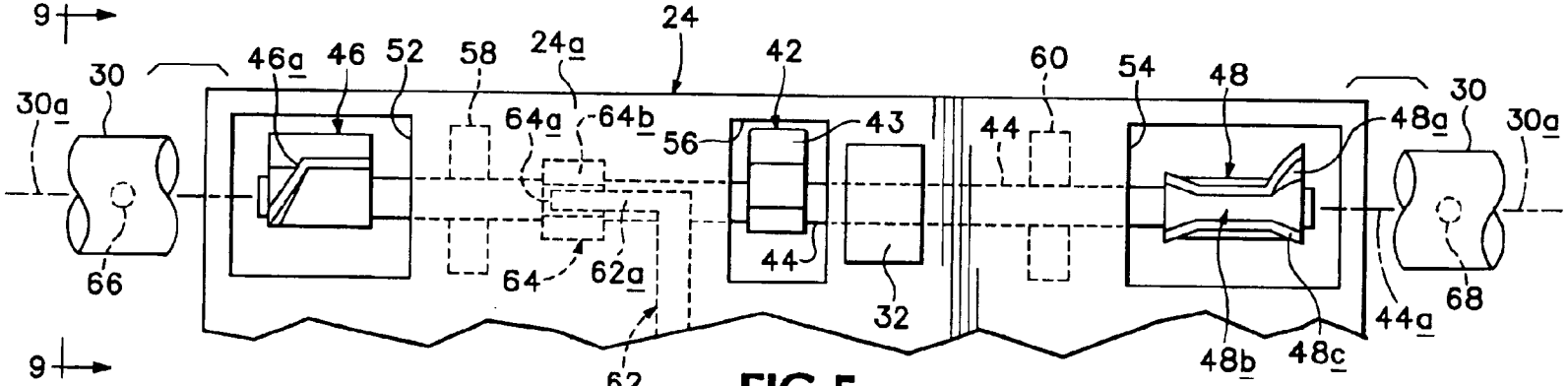
FIG. 5 is an enlarged, fragmentary underside view of the front portion of a carriage which forms part of the printer of FIGS. 2, 3 and 4, illustrating certain details of rotary components employed in the embodiment of the invention incorporated therein, with these components shown in the conditions which they assume with the printhead-to-media spacing adjusted to its smallest value.
Figure 6:
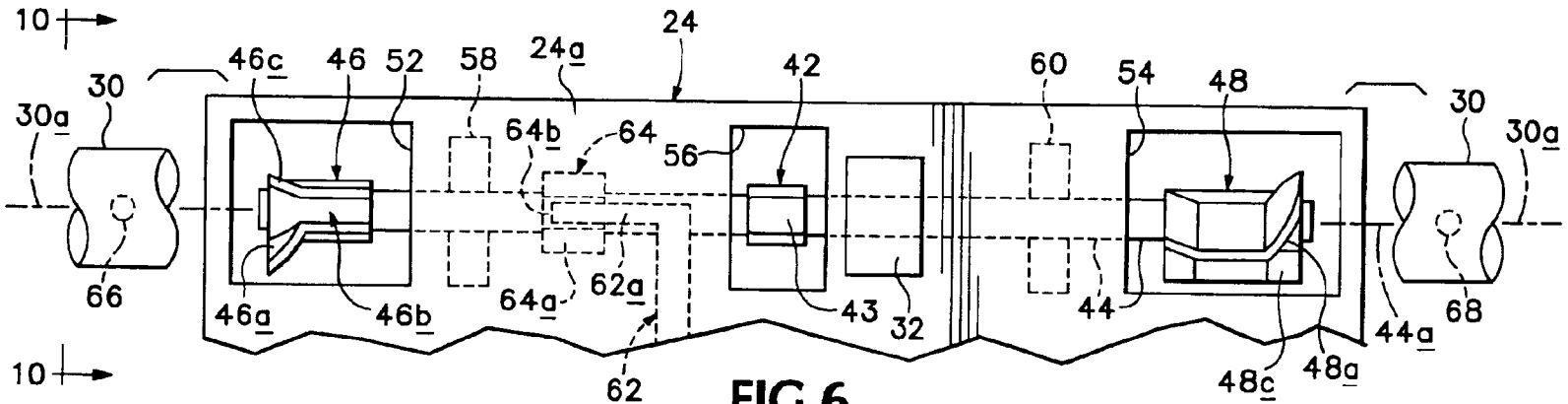
FIG. 6 is very similar to FIG. 5, but here pictures the same rotary components in the conditions which they assume with the printhead-to-media spacing at its largest value.
Figure 11:
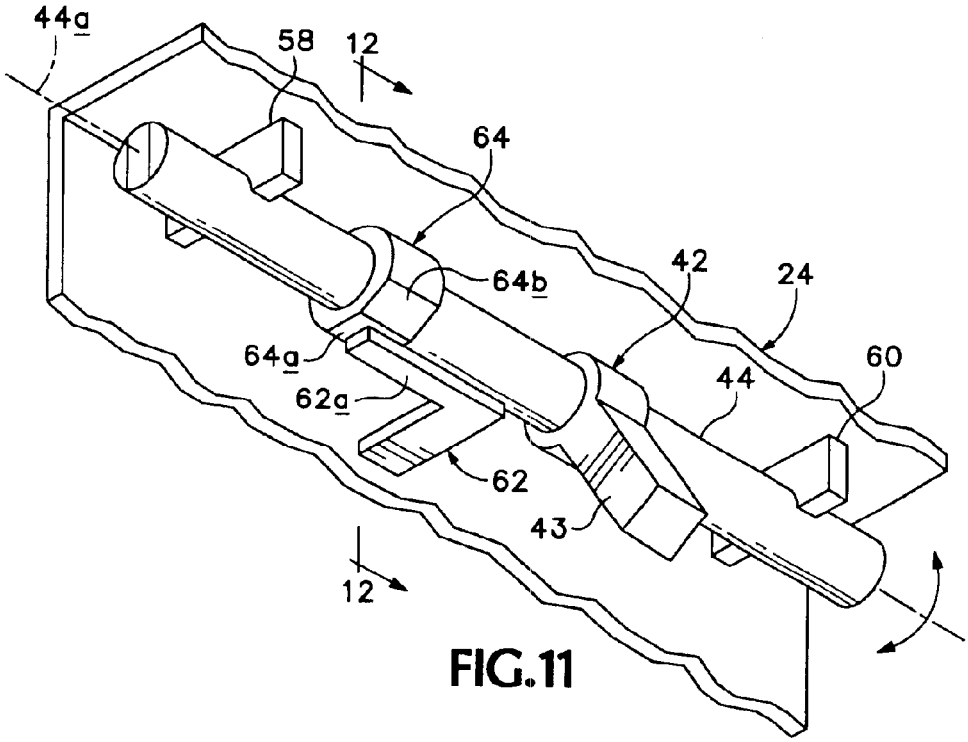
FIG. 11 is an underside isometric view further picturing the rotary components of FIGS. 5–7, inclusive, and specifically illustrating the construction of associated detent and bearing structure that mounts these components on the underside of the carriage.
Figure 12:
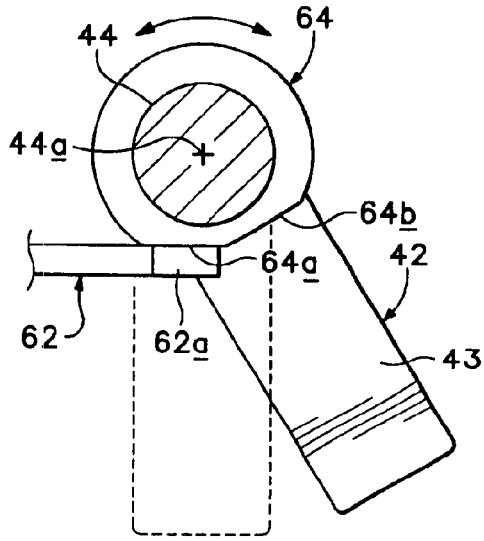
FIG. 12 is a view taken generally along the line 12—12 in FIG. 11.

Shaft 44 is supported for rotation about its long axis on carriage 24 through a pair of downwardly facing laterally spaced saddles 58, 60, and by a spring-finger structure 62 which includes a spring finger 62*a* that engages a dual faceted collar 64 appropriately joined to shaft 44 at the location indicated. Collar 64 includes a pair of adjacent outwardly facing, angularly disposed, flat facets 64*a*, 64*b* whose function will be explained shortly. In FIGS. 5, 6 and 11, finger 62*a* is shown engaging facet 64*a*. Regarding the relative positions which are shown for components of apparatus 33 in FIGS. 2, 3, 5, 9 and 11, finger 43 extends downwardly and forwardly relative to the carriage, with this finger being out of contact with rail 30.

Figure 7:
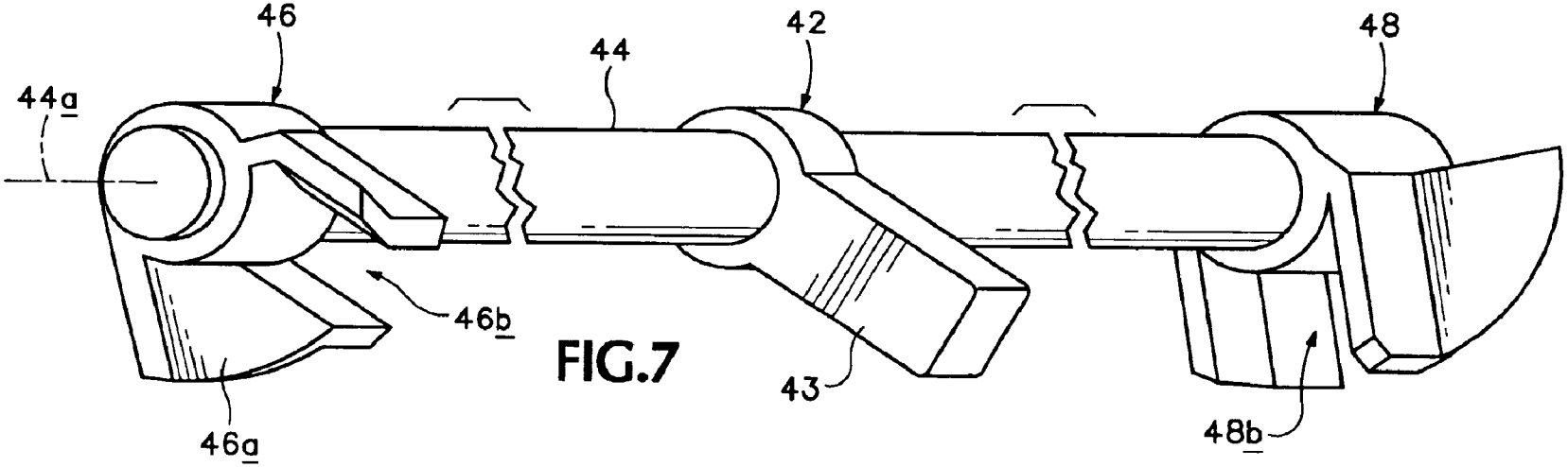
FIG. 7 shows an isolated view of the rotary components pictured in FIGS. 5 and 6.

Cams 46, 48 are configured, as can be seen especially in FIGS. 5, 6 and 7, have an axially outwardly facing cam surfaces 46*a*, 48*a*, respectively. Each of these cam surfaces preferably takes the form of the flight of an appropriate helix, with cam surface 46*a* leading to an open passage 46*b* that extends generally along and parallel to shaft axis 44*a*, and with cam surface 48*a* leading to a similar passage 48*b*. Also formed in cams 46, 48, and cooperating with cam surfaces 46*a*, 48*a*, respectively, are axially outwardly flared portions 46*c*, 48*c*, respectively, which cooperate with their respective associated cam surfaces to define a kind of funneling entryway (axially from the outer ends of shaft 44) into previously-mentioned passages 46*b*, 48*b*, respectively.

Figure 2:
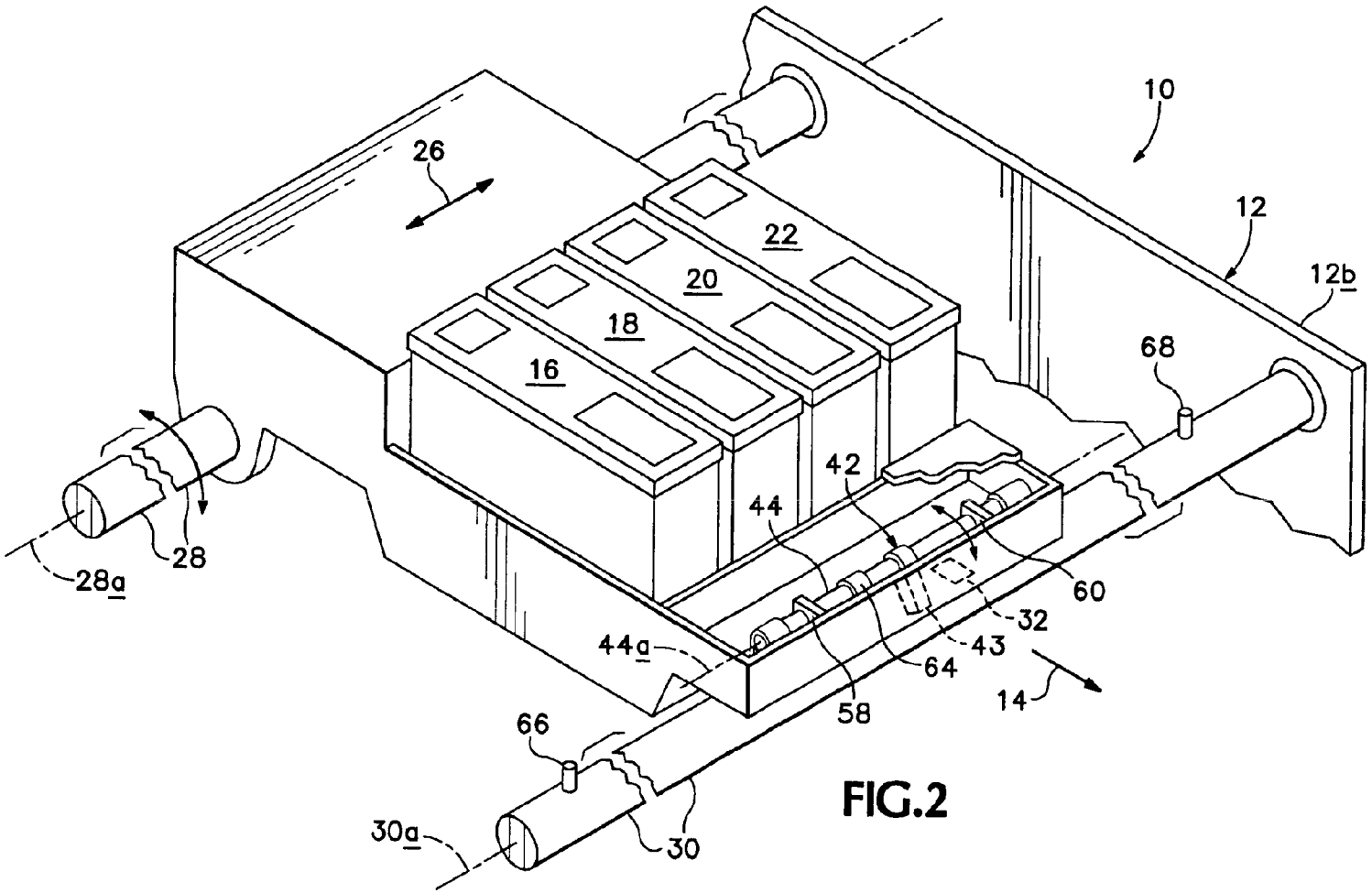
FIG. 2 is a isometric, larger-scale view of the printer of FIG. 1, more specifically showing one embodiment of the invention.

Completing a description of apparatus 33, suitably joined to the upper surface of anti-rotation rail 30, at the locations generally shown in FIGS. 2, 5 and 6 are upstanding pin-like projections, 66, 68. Projections 66, 68 (illustrated as simple blocks 38, 40, respectively, in FIG. 1) lie in a common upright plane, and are located within previously mentioned regions $BR_1$, $BR_2$, respectively, relative to range R. These pins are positioned to be engaged by the cam surfaces in cams 46, 48 under certain circumstances (still-to-be-explained) of lateral shifting of carriage 24.

As can be observed from looking at FIGS. 5–7, inclusive, cams 46, 48 have an angular relationship relative to one another (as viewed, for example, along axis 44*a*) whereby their respective helical cam surfaces, and adjoining axially extending passages, are angularly offset. This offset has an angular value that relates to angular rotation of bearing structure 42 to create changes in printhead-to-media spacing.

Explaining now the operation of apparatus 33, with printer 10 residing in a normal and default condition awaiting instructions to engage in a printing operation, carriage 24 sits in its home position. In this condition, the carriage is effectively in a position beyond end $E_2$ of print range R, and specifically in a condition at least partially occupying region $BR_2$. Under these circumstances, projection 68 resides within passage 48*b* in cam 48 (a condition not expressly shown in the drawings), and shaft 44 is in a rotated condition with bearing finger 43 inclined forwardly and downwardly as pictured in FIGS. 2, 3, 5, 9 and 11. Finger 43 is out of contact with anti-rotational rail 30, and bearing pad 32 rests in the top surface of the rail. This condition defines an angular (rocked) position for carriage 24 which produces the mentioned, smaller default printhead-to-media spacing shown at $S_1$ in FIG. 3.

When printer 10 is called upon to implement a printing operation without there being any need to change printhead-to-media spacing, the printer is appropriately driven out of its home position for lateral shifting and reciprocation in the usual manner within print-job range R. This operation does not in any way change the preset, default printhead-to-media spacing.

At the end of such a normal and usual printing operation, and without there being any "instruction" to change printhead-to-media spacing, the carriage returns to its home position, and all components in apparatus 33 remain in the relative positions which they had at the beginning of the described printing operation.

When, however, there is an instruction given to increase printhead-to-media spacing in order to accommodate thicker print media, carriage 24 is shifted outwardly from its home position to a location beyond the far end $E_1$ of normal printing range R, and specifically somewhat into region $BR_1$. The carriage is shifted far enough to cause cam surface 46*a* in cam 46 to engage pin 66. Such engagement, with some continued outward lateral motion of the carriage toward frame structure 12*a*, causes rotation of cam 46, and hence of shaft 44, bearing structure 42 and finger 43, generally in a clockwise direction as such components are viewed along axis 44*a* from the left end of that axis of such is pictured in the various drawing figures. This rotation is angularly large enough to cause shaft 44 to rotate through a condition wherein finger 43 engages and climbs up onto rail 30. This action causes the front of the carriage to lift with rocking of the carriage about axis 28*a*. Such shaft rotation and carriage rocking causes spring finger 62*a* to unseat from collar facet 64*a*, and to seat now against collar facet 64*b*. This seating of finger 62*a* on facet 64*b* tends to retain the rotated components in a new angular disposition, with finger 43 extending downwardly with its outer end squarely on top of anti-rotational rail 30. This condition is pictured in FIGS. 4, 6 and 10.

The carriage is now withdrawn from region $BR_1$ for normal lateral printing reciprocation within range R.

So long as the carriage remains within range R, nothing changes vis-a-vis printhead-to-media spacing. However, when such a printing operation is completed, and an instruction is given to send carriage 24 back to its home position in the printer, such lateral shifting drives the carriage into region $BR_2$, and cam surface 48*a* in cam 48 to engage pin 68. This engagement, with modest continued advancement of the carriage outwardly into its home position, causes the rotary components in the adjustment mechanism (i.e. shaft 44, cams 46, 48 and bearing structure 42), to return to the conditions which they initially held just prior to implementation of the thick-media printing operation. Such rotation causes spring finger 62*a* to unseat from facet 64*b* and to reseat against collar facet 64*a*, thus to tend now to hold the rotatable components in the adjustment mechanism in the same angular and rotated conditions which they had prior to implementation of the thick media printing operation.

Figure 3:
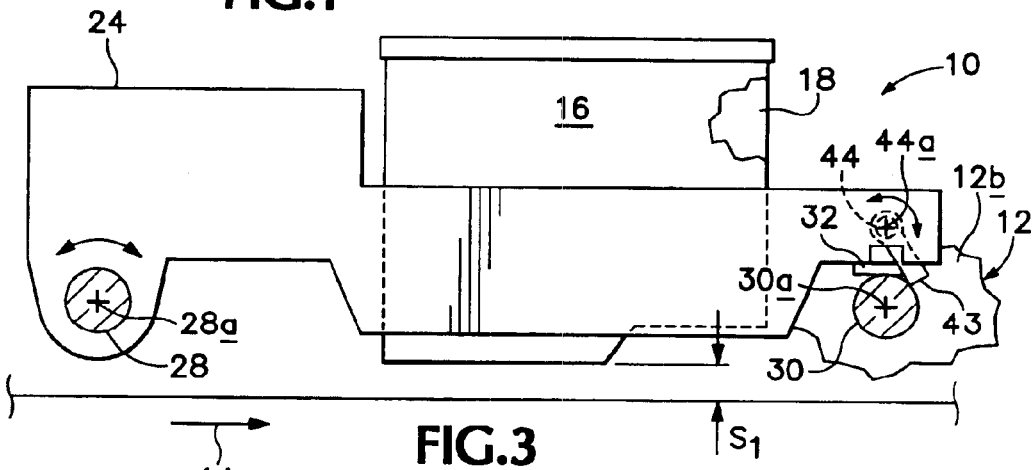
FIG. 3 is a fragmentary side elevation taken generally from the lower left side of FIG. 2, showing an adjusted printhead-to-media spacing $S_1$ which is at its smallest value in the pictured printer.
Figure 4:
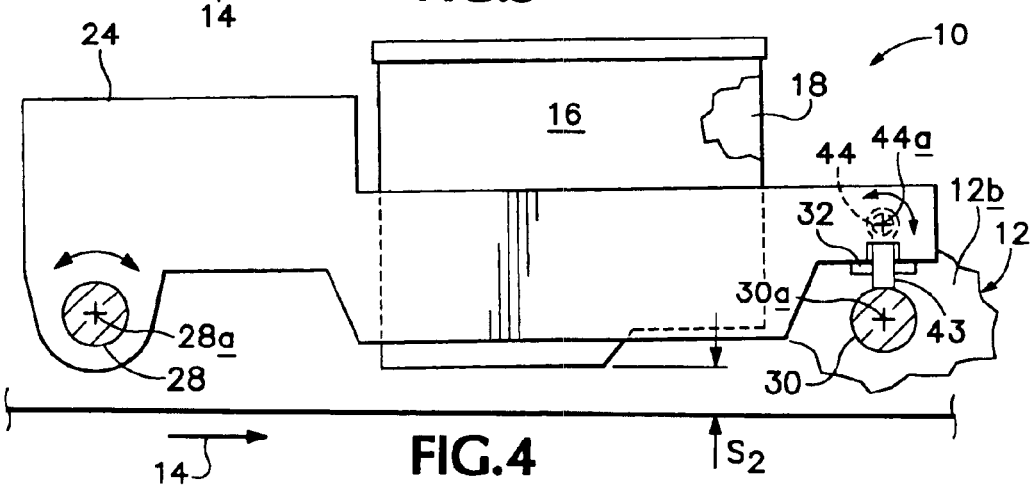
FIG. 4 is a view similar to that presented in FIG. 2, but here showing an adjusted printhead-to-media spacing $S_2$ which is at its largest value in the illustrated printer.
Figure 8:
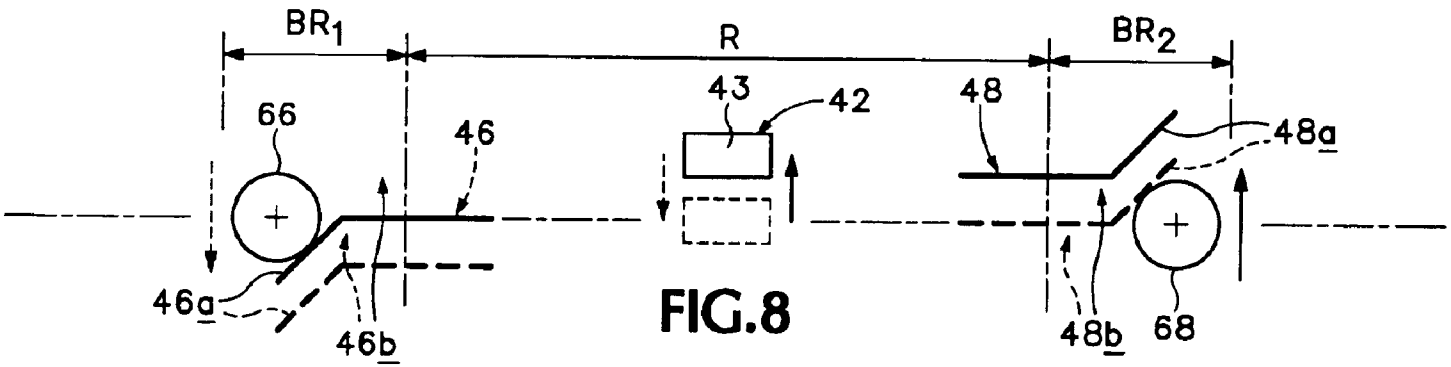
FIG. 8 is a schematic view which is presented to illustrate the operation of the specific embodiment of the invention contained in the printer of FIGS. 2–6, inclusive.
Figure 9:
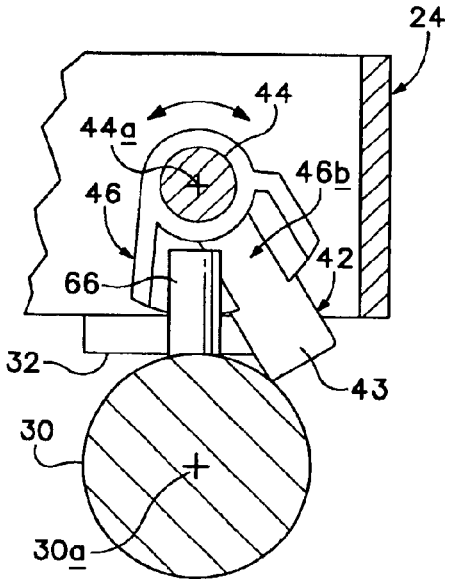
FIG. 9 is a view taken generally along the line 9—9 in FIG. 5, rotated 90° clockwise to show the illustrated structure in an upright condition.
Figure 10:
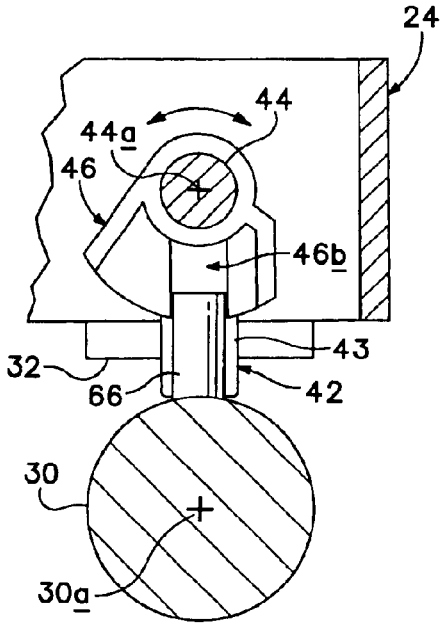
FIG. 10 is similar to FIG. 9 except that it is taken generally along the line 10—10 in FIG. 6.

In the schematic layout presented in FIG. 8, solid lines for components 42, 43, 46, 46*a*, 48 and 48*a* relative to pins 66, 68 illustrate the rotated conditions of these components when the carriage is disposed lowered, with pad 32 resting on rail 30 (see especially FIG. 3—neither pad 32 nor rail 30 is being specifically illustrated in FIG. 8). Such conditions are the ones extant with printhead-to-media spacing at its small, default value $S_1$. Dashed lines show these same components (relative to pins 66, 68) in their respective rotated conditions when the front of the carriage is rocked upwardly, and with the outer end of finger 43 resting on the upper surface of rail 30 as shown in FIG. 4.

The solid-line representations in FIG. 8 shown for bearing structures 42 and for cams 46, 48 in relation to pins 66, 68 depict the condition that exists just following engagement of cam surface 48*a* and pin 68. After such an engagement, pin 68 is aligned for clearance within cam passage 48*b*, and cam surface 46*a* is aligned for possible engagement with pin 66 in the event of an instruction being given to increase PPS to the value of $S_2$.

The dashed-line representations illustrate the condition which exists just following engagement of cam surface 46*a* and pin 66. In this condition, pin 66 is aligned for clearance within cam passage 46*b*, and cam surface 48*a* is aligned for possible engagement with pin 68 when the carriage returns to its home position in the printer.

The vertically directed solid-line and dashed-line arrows in FIG. 8 picture shifting of the components just discussed to the solid-line and dashed-line conditions, respectively, in FIG. 8.

According to a second embodiment of the invention, instead of there being fixed and movable actuators on opposite lateral sides of the carriage and printer frame, only a one-sided arrangement is employed for apparatus 33. This alternative embodiment of this apparatus 33 is pictured in FIG. 13. In general terms, and referring back to FIG. 1, alternative version of apparatus 33 has components effectively occupying the locations in FIG. 1 of movable contact actuator 34, fixed contact actuator 38, bearing structure 42 and the driving connection shown in FIG. 1 labeled 41 and extending between actuator 34 and structure 42.

Included in this embodiment of apparatus 33 are a rotary ratchet-like wheel 70 which is rotatably mounted on a shaft 72 which in turn is suitably anchored to carriage 24. Shaft 72 provides an axis 72*a* about which wheel 70 rotates unidirectionally as illustrated by clockwise-directed curved arrow 73.

Wheel 70 includes one portion 70*a* that is formed with four quadrature-disposed projections, such as projections 70*b*, and with four quadrature-disposed valleys, such as valleys 70*c*, between projections 70*b*. Wheel 70 also includes another portion 70*d* that is located axially toward the viewer in FIG. 13 relative to portion 70*a*, with portion 70*d* including eight, equiangularly distributed projections 70*e* separated by eight inwardly curved equiangularly displaced valleys, such as valleys 70*f*. The relative angular dispositions of the projections and valleys in wheel portions 70*a*, 70*d* are clearly pictured in FIG. 13.

Also forming part of this apparatus is an elongate, generally cylindrical push button 74 which is slidably received in a suitable accommodating bore 76 provided at an appropriate location on the side of carriage 24. Push button 74 includes a pair of axially displaced inner and outer shoulder rings 74*a* disposed as shown, and an inwardly extending elongate stem 74*b*. A compression biasing spring 78 acts between carriage 24 and outer ring 74*a* to urge the button outwardly of the carriage and toward the left in FIG. 13. The outer end of button 74 faces and is aligned with a frame component 12*c* in FIG. 13.

Co-acting with wheel 70 is a spring detent element 80 which includes an outer curved end 80*a* that is adapted to be received within previously-mentioned valleys 70*f*. This detent element is appropriately mounted on carriage 24 in a manner which allows end 80*a* to seat within the mentioned valleys so as to tend to hold the wheel in a stable rotated position relative to axis 72*a*, and yet to allow rotation of wheel 70 in steps in the direction of arrow 73. Also cooperatively related to wheel 70, and forming part of this apparatus, is a plunger 82 which includes an elongate, downwardly extending finger 82*a* that extends slidably through a suitable accommodating bore 84 provided on the under side of carriage 24. A biasing spring 86 acts under compression around finger 82*a*, and between carriage 24 and a shoulder 82*b* which is formed in plunger 82. Spring 86 urges the plunger upwardly in FIG. 13. The upper end of plunger 82 is engaged, as pictured in FIG. 13, with one of projections 70*b* in wheel 70. Specifically, the engagement shown in FIG. 13 between plunger 82 and wheel 70*a* is one which causes the lower end of finger 82*a* to extend downwardly beneath the carriage and to engage the upper surface of anti-rotation rail 30. Specifically, this is the condition pictured in solid lines in FIG. 13, and is a condition wherein the front of the carriage is lifted above the anti-rotation rail, and rocked slightly relative to axis 28*a*, to create a printhead-to-media spacing $S_2$ which is the greater of the two such spacings discussed so far herein. Stem 74*b* is shown engaging the left side of one of projections 70*e* in wheel portion 70*d*.

Figure 13:
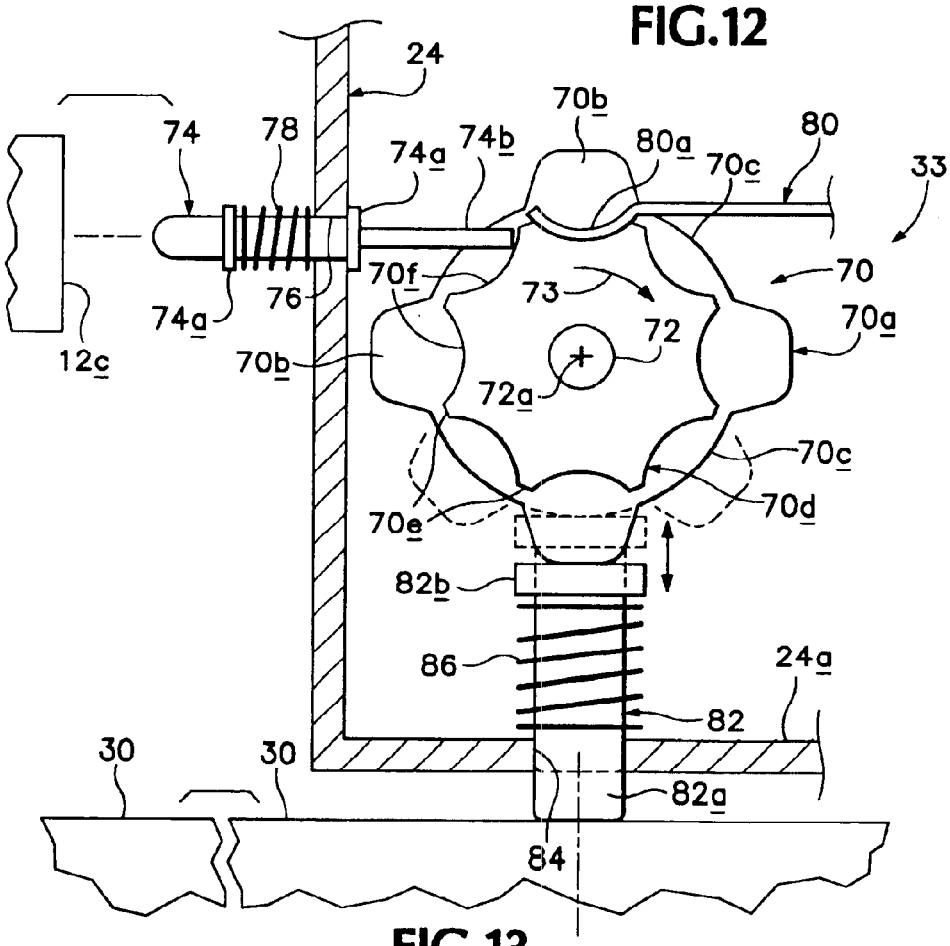
FIG. 13 is a view taken generally from the point of view represented by line 13—13 in FIG. 1, illustrating an alternative embodiment of printhead-to-media spacing adjustment apparatus constructed in accordance with an embodiment of the present invention.

Under normal default operating conditions in printer 10, the components in the apparatus pictured in FIG. 13 normally are arranged in a manner whereby wheel 70 sits in a rotated condition with the upper end of plunger 82 biased upwardly by spring 86 and in contact with one of valleys 70*c* in wheel portion 70*a*. Under this circumstance, the lower end of finger 82*a* may be effectively raised above the lower surface of carriage 24, and the carriage may rest, through pad 32, on the upper surface of the anti-rotation rail to define what was described earlier as the default, smaller printhead-to-media spacing $S_1$.

When it is desired to accommodate thicker than normal print media, carriage 24 is driven toward and into region $BR_1$ beyond end $E_1$ of range R, and specifically far enough to cause the outer end of push button 74 to engage frame component 12*c*, and to cause a single-step slight angular rotation of wheel 70 in the direction of arrow 74 through shifting of the push button against the action of spring 78. Such an action causes the detent element end 80*a* to climb out of the particular valley 70*f* in wheel portion 70*d* wherein it sits at the time that this occurs, and effectively to snap into the next angularly adjacent similar valley in wheel portion 70*d*. This action involving stepped rotation of wheel 70 causes an engagement to occur between one of projection 70*b* and the upper end of plunger 82 to drive the lower end of finger 82*a* downwardly against the upper surface of the anti-rotational rail as is pictured in FIG. 13. This condition establishes the greater printhead-to-media spacing $S_2$.

The carriage is then returned for normal reciprocal operation within range R, and printhead-to-media spacing is maintained at the greater value $S_2$ until there is a next actuation of the components making up the structure of the embodiment of the invention pictured in FIG. 13.

When it is desired to return to the default printhead-to-media spacing, the carriage is shifted once more into region $BR_1$ to cause another actuation engagement between push button 74 and frame structure 12*c*. This next actuation event causes another "snap action" modest angular rotation of wheel 70 to return all components in the actuation mechanism to the conditions which they held in the default status of printer 10. Thus, the mechanism pictured in FIG. 13 operates in a kind of bi-stable manner with successive actuations that take place at one side only of the printer frame and the carriage. Successive actuations cause successive, alternating establishments of the two different printhead-to-media spacings specifically provided for herein by apparatus 33.

It will thus be apparent that the apparatus constructed in accordance with an embodiment of the present invention uniquely takes advantage of the normal motor drive arrangement furnished for reciprocating a carriage during a printing operation to provide the necessary action and power to perform desired changes between different printhead-to-media spacings. No additional motors or other additional electrical components are required.

INDUSTRIAL APPLICABILITY

Printers are typically furnished with printhead carrying carriages that reciprocate laterally during a printing operation, and which can be rocked vertically to adjust printhead-to-media spacing in order to accommodate different thicknesses of print media. The invented mechanism enables selective adjustment of this spacing through the use of relatively simple and economical stationary and movable actuators which can engage near one or both ends, and slightly beyond, the normal print-job lateral reciprocation range provided for a carriage. These engagements act through mechanisms driven by the movable actuators to create appropriate carriage rocking, and hence changing of the printhead-to-media spacing. Carriage movement to cause such engagements takes place substantially solely under the influence of the usual motor drive which is normally provided for reciprocating the carriage.

What is claimed is:

1. Apparatus for adjusting printhead-to-media spacing in a printer having a frame and a shiftable printhead-carrying carriage mounted on the frame for lateral movement relative to the frame, the apparatus comprising:

a first stationary mechanical contact actuator anchored to the frame and disposed beyond one end of a print-job range;

a first movable mechanical contact actuator movable with the carriage, positioned toward that side of the carriage which generally faces the first stationary actuator, and engageable with the first stationary actuator during movement of the carriage beyond the one end of the print-job range to cause a positional adjustment of the carriage which effects a change in printhead-to-media spacing; and a rotatable component, wherein said first stationary actuator includes a projection mounted on an elongate rail which at least partially supports the carriage during lateral movement, and the first movable actuator takes the form of a rotation-implementing first cam drivingly joined to the rotatable component, and engageable with the projection during movement of the carriage beyond the one end of the print-job range to cause rotation of the rotatable component.

2. The apparatus of claim 1, wherein the rotatable component carries a rotatable bearing structure which rotates between positions of engagement and non-engagement with the rail during rotation of the rotatable component, and wherein the position of engagement produces one printhead-to-media spacing, and the position of non-engagement produces another print-to-media spacing.

3. The apparatus of claim 1, wherein the rotatable component takes the form of an elongate shaft mounted on the carriage for a rotation about a long axis of the shaft, and wherein the shaft carries rotatable bearing structure that includes an elongate finger which extends radially relative to the shaft such that the finger, with rotation of the shaft, selectively engages and disengages the rail to effect a change in printhead-to-media spacing.

4. The apparatus of claim 3, wherein the first cam includes an axially outwardly facing, at least partially helical, cam surface that is contactable with the projection.

5. Apparatus for adjusting printhead-to-media spacing in a printer having a frame and a shiftable printhead-carrying carriage mounted on the frame for lateral movement relative to the frame, the apparatus comprising:

a first stationary mechanical contact actuator anchored to the frame and disposed beyond one end of a print-job range; and a first moveable mechanical contact actuator movable with the carriage, positioned toward that side of the carriage which generally faces the first stationary actuator, and engageable with the first stationary actuator during movement of the carriage beyond the one end of the print-job range to cause a positional adjustment of the carriage which effects a change in printhead-to-media spacing;

wherein the carriage is adjustable via a rocking motion to establish different printhead-to-media spacings, the first stationary actuator includes a plate structure joined to the frame, and the first moveable actuator includes a spring-biased push-button and a rotary ratchet wheel rotatably mounted on the carriage, and an elongated movable finger drivingly associated with the wheel, and collectively therewith exhibiting bi-stable behavior in relation to successive engagements occurring between the push-button and the plate structure, such bi-stable behavior creating alternating rocking of the carriage to establish different selected printhead-to-media spacings.

6. Apparatus for adjusting printhead-to-media spacing in a printer having a frame and a shiftable printhead carriage mounted for movement relative to the frame, the apparatus comprising:

a stationary actuator, fixed relative to the frame and disposed beyond an end of a print range;

bearing structure mounted on the carriage and engageable with an elongated rail during movement of the carriage to define printhead-to-media spacing; and a moveable actuator engageable with the stationary actuator during movement of the carriage beyond the end of print range, such engagement being effective to cause a positional adjustment of the bearing structure relative to the carriage, and thereby, to effect a change in printhead-to-media spacing;

wherein the moveable actuator includes a cam drivingly joined to the bearing structure and engageable with the stationary actuator during movement of the carriage beyond the end of the print range to cause adjustment of the bearing structure, and the bearing structure includes a rotatable finger that selectively engages and disengages the rail to effect a change in printhead-to-media spacing.

* * * * *